US008033362B1

(12) United States Patent
Cull

(10) Patent No.: US 8,033,362 B1
(45) Date of Patent: Oct. 11, 2011

(54) PAINT TRAY CADDY FOR EXTENSION LADDERS AND METHOD OF USE THEREOF

(76) Inventor: Gerald R. Cull, Cedar Hill, MO (US)

( * ) Notice: Subject to any disclaimer, the term of this patent is extended or adjusted under 35 U.S.C. 154(b) by 1062 days.

(21) Appl. No.: 11/879,827

(22) Filed: Jul. 19, 2007

(51) Int. Cl.
*E06C 7/14* (2006.01)

(52) U.S. Cl. ..... 182/129; 182/121; 248/210; 248/238

(58) Field of Classification Search ..... 182/129, 182/121; 248/210, 238
See application file for complete search history.

(56) References Cited

U.S. PATENT DOCUMENTS

| | | | | | |
|---|---|---|---|---|---|
| 2,871,067 | A | * | 1/1959 | Brogdon | 182/121 |
| 4,120,472 | A | | 10/1978 | Balne | |
| 4,222,541 | A | * | 9/1980 | Cillis | 248/210 |
| 4,480,810 | A | | 11/1984 | Hall | |
| 4,482,030 | A | * | 11/1984 | Lincourt | 182/121 |
| D347,306 | S | | 5/1994 | Rogers et al. | |
| 5,431,249 | A | * | 7/1995 | Tredup | 182/129 |
| 5,461,752 | A | | 10/1995 | Lemon et al. | |
| 5,842,253 | A | | 12/1998 | Ahl et al. | |
| 5,957,238 | A | * | 9/1999 | Curvin, II | 182/129 |
| 6,089,351 | A | | 7/2000 | Ahl et al. | |
| D431,302 | S | | 9/2000 | Bresko | |
| 6,131,699 | A | * | 10/2000 | Leak, Jr. | 182/129 |
| 6,148,958 | A | | 11/2000 | Ahl et al. | |
| 6,273,289 | B1 | | 8/2001 | Bowman | |
| 6,622,340 | B2 | | 9/2003 | Rosa | |
| 6,848,540 | B2 | * | 2/2005 | Kvam | 182/129 |
| 6,862,755 | B1 | * | 3/2005 | Crachy | 4/496 |
| 7,354,023 | B1 | * | 4/2008 | Wappler | 248/206.5 |
| 2001/0047905 | A1 | * | 12/2001 | Boyer | 182/15 |
| 2004/0099675 | A1 | * | 5/2004 | Peck | 220/737 |
| 2006/0131106 | A1 | * | 6/2006 | Adams | 182/129 |
| 2008/0035426 | A1 | * | 2/2008 | Leuthner | 182/129 |

* cited by examiner

*Primary Examiner* — Katherine Mitchell
*Assistant Examiner* — Daniel Cahn
(74) *Attorney, Agent, or Firm* — Montgomery Patent & Design; Robert C. Montgomery; Joseph T. Yaksich

(57) ABSTRACT

A caddy apparatus designed to hold paint, construction items, supplies, tools and other materials while on an extension ladder without interfering with the safety of the person standing on the ladder is herein disclosed. The apparatus uses a dimensioned dowel rod which is selectably placed through the hollow cavity of the ladder rungs and extends through to either side where it is used to support the apparatus. The apparatus comprises a "U"-shaped bracket, which is supported on the dowel rod in any one of three closely-spaced hanging tubes. The base of the bracket provides a large flat tray for use in holding materials while working on the extension ladder. The use of said caddy allows workers on extension ladders quick access to tools, supplies and materials in an efficient and safe manner.

4 Claims, 3 Drawing Sheets

PAINT TRAY CADDY FOR EXTENSION LADDERS AND METHOD OF USE THEREOF

RELATED APPLICATIONS

The present invention was first described in and claims the benefit of Disclosure Document No. 608,330, filed Nov. 2, 2006, the entire disclosures of which are incorporated herein by reference.

FIELD OF THE INVENTION

This invention relates to paint tray caddies and, more particularly, to a paint tray caddy employable with an extension ladder for holding paint and working tools without interfering with the safety of a person standing on the ladder.

BACKGROUND OF THE INVENTION

There is a seemingly endless list of activities performed at home, work, and in m any other environments that require the use of a ladder in order to allow its user to gain access to areas that otherwise would be inaccessible. However, as handy as ladders are, they are not without their disadvantages. Perhaps the biggest disadvantage is that they do not provide a work area or storage area for the person on the ladder. This requires the person to carry any tools or supplies needed for the task with them while climbing the ladder, either in their hands, pockets, or tool belt. This obviously compromises safety. Additionally, the situation inevitably arises where the required tool, supply item or material is not on hand and, as a result, time and money are wasted in climbing back down the ladder, tracking the item down and then climbing back up the ladder.

Several attempts have been made in the past to develop a paint tray caddy employable with extension ladders for holding paint and working tools without interfering with the safety of a person standing on the ladder. U.S. Pat. No. 6,273,289 in the name of Bowman discloses a portable container capable of holding paint cans, paint supplies, brushes, and paint-related tools. The container is shaped like a trapezoidal prism with the front and back being parallel and the top and bottom also being parallel to each other. The container on the top has a number of wells that allows for placement of cans of paint and other paint-related material, including brushes. There are also openings in the side where paint-related materials can also be placed as well as paint scrapers, hammers, hooks, and rags. On the back of the container are four hook-like devices that are designed to fit over the rungs of a ladder. When the painter uses the container he first places the ladder up against the building. He then fills the invention with the paint can and brushes he wishes to use. He picks up the invention, carries it up the ladder to the rung in which he wishes for the invention to be on and places it over that rung. As he paints, his body weight is up against the container and thus holds the container securely in place on the ladder. Unfortunately, this prior art example is not suitable for holding odd shaped objects such as saws and drills.

U.S. Pat. No. 6,148,958 in the name of Ahl, et al discloses a ladder supported holding tray assembly for releasable attachment to a ladder that includes a generally horizontal container including opposing side panels, a front, a back, and a bottom. The tray assembly also includes a ladder attachment bracket including a connecting wall attaching the bracket to a side panel of the tray. Step engagement means are disposed on the bracket, wherein the step engagement means comprises an upward sloping surface to releasably engage and securely hook onto a step from underneath the step. The tray when mounted on a ladder extends laterally outwardly from the ladder so as to not interfere with the normal use of the ladder. Unfortunately, this prior art example interferes with a user's ability to safely and easily move up and down an existing ladder.

U.S. Pat. No. 5,842,253 in the name of Ahl, et al describes a ladder supported holding tray that comprises a tray assembly for releasable attachment to a step ladder or to an extension ladder that typically comprises an open top container including at least a front panel, a back panel, a first side panel, an second side panel, and a bottom joined together to define a hollow interior receptacle. First step engagement members are disposed on the container proximate to the container bottom to permit secure temporary engagement of the tray to a first step of a step ladder, to a first single rung of an extension ladder, or to first side by side rungs of overlapping sections of an extension ladder. Second step engagement member are disposed on the tray assembly proximate to the open top of the container to permit secure temporary engagement to a second step of a step ladder, a second single rung of an extension ladder, or a second rung of side by side rungs of overlapping sections of an extension ladder. The second step engagement member contacts only the bottom surface of a second step or rung. Unfortunately, this prior art example is not designed for holding odd shaped items and further also impedes the ability of a user to move up and down the ladder while the apparatus is attached thereto.

None of the prior art particularly describes a paint tray caddy employable with extension ladders for holding paint and working tools without interfering with the safety of a person standing on the ladder. Accordingly, there is a need for an apparatus which provides such features while overcoming the above-noted shortcomings.

SUMMARY OF THE INVENTION

In view of the foregoing disadvantages inherent in the prior art, it has been observed that there is need for a paint tray caddy employable with extension ladders for holding paint and working tools without interfering with the safety of a person standing on the ladder.

The present invention is an apparatus designed to hold paint, painting supplies, tools and materials while on an extension ladder. The invention uses a wooden dowel rod which is placed into the hollow cavity provided by the cylindrical steps on an extension ladder. In such a manner the dowel can be placed anywhere on the ladder where it is needed. The dowel rod is then allowed to extend out either the left or right side of the ladder where it is used to support a "U-shaped" bracket from one of three closely spaced hanging tubes. The tube which provides the desired location with regards to front to rear spacing would be used. The bottom part of the bracket then provides a large flat tray for use in holding paint, painting supplies, tools, materials or anything that is used while on an extension ladder. The use of the present invention allows workers on ladders the instant access to tools, supplies and materials they need in a quick, easy and effective manner while increasing safety and saving money.

The apparatus includes a substantially rectangular-shaped tray that has longitudinally opposed ends. Such a tray includes a platform, and a plurality of side panels monolithically formed along outer edges of the platform. Each of such side panels has an equal height, and the side panels extend upwardly and away from the platform at a right angle to a top surface thereof. The platform and the side panels respectively cooperate to form an open chamber therebetween, which is essential for housing a variety of existing objects therein during operating conditions. Such cooperation of the side panels and the platform respectively allows the user to confidently place a plurality of differently shaped objects within the open chamber.

The apparatus further includes a frame that has a lower end connected to the tray. Such a frame includes a pair of coextensively shaped rectilinear upper arms provided with opposed proximal and distal ends respectively, and a pair of coextensively shaped rectilinear rear arms that have respective top ends monolithically form with respective distal ends of the upper arms. Such rear arms have respective longitudinal lengths oriented orthogonally to respective longitudinal lengths of the upper arms, and the rear arms extend downwardly and away from the upper arms. Such upper and rear arms respectively cooperate to keep the tray properly spaced from the existing ladder during operating conditions.

The frame further includes a lower frame that has an open end integrally attached to the bottom ends respectively of the rear arms. Such a lower frame has a closed end extending outwardly and away from the open end of the lower frame. The lower frame has a top surface registered parallel to a bottom surface of the respective upper arms, which is crucial such that the upper arms and the rear arms and the lower frame respectively cooperate to form a substantially "C"-shaped structure. Such a "C"-shape allows the user to easily place and retrieve objects from the tray during operating conditions. A plurality of threaded apertures is formed in the lower frame, and each of the apertures has a centrally registered axis oriented at a right angle to the top surface of the lower frame. Such apertures are equidistantly spaced along the lower frame. Such apertures allow the user to remove the tray from the lower frame for transport, storage, and repair respectively.

The apparatus further includes a mechanism for removably attaching the paint tray caddy to an existing ladder. Such a removable attaching mechanism is connected directly to an upper end of the frame, without the use of intervening elements, and includes a plurality of coextensively shaped hanging tubes attached directly to a top surface of the proximal ends of the upper arms, without the use of intervening elements. Such tubes are statically connected horizontally in a side-by-side sequence along respective longitudinal lengths thereof. Each of the tubes has a longitudinal length registered parallel to an associated one of the tubes and further has respective longitudinal lengths registered at a right angle to the respective longitudinal lengths of the upper arms. The tubes are spaced from the tray and further are oriented above a center region of the tray. A pair of pivot ears is integrally attached to axially opposed ends of a selected one of the tubes. Such pivot ears extend away from the tube along the horizontal plane and toward the respective distal ends of the upper arms. The removable attaching mechanism allows the user to easily and quickly reposition the apparatus on an existing ladder during operating conditions, or alternatively, removably attach the apparatus to another existing ladder based upon need.

The removable attaching mechanism further includes a pair of locking plates pivotally attached to the pivot ears, and each of the locking plates has a plurality of openings formed therein and equidistantly spaced therealong. Each of such openings has a diameter that is equal to a diameter of each of the tubes, which is critical such that the openings of a selected locking plate are in fluid communication with associated ones of the tubes during operating conditions. An elongated first stop member is integrally attached to the respective bottom surfaces of the upper arms, and the first stop member has a longitudinal length registered perpendicular to the respective longitudinal lengths of the upper arms. Such a first stop member is located medially of the tubes and the respective distal ends of the upper arms respectively.

The removable attaching mechanism further includes a rectilinear second stop member integrally attached to the respective bottom surfaces of the upper arms. Such a second stop member has a longitudinal length registered perpendicular to the respective longitudinal lengths of the upper arms, and the second stop member is located subjacent of the tubes and spaced from the first stop member. A first dowel rod has axially opposed and threaded proximal and distal ends respectively, and the proximal end of the first dowel rod is removably interfitted within a selected one of the plurality of tubes. The proximal end of the first dowel rod is threadably interfitted within an associated one of the openings of the locking plate when the first dowel rod is removably interfitted within the selected tube. The first and second stop members respectively provide an additional measure of safety when employing the apparatus by preventing an associated locking plate from prematurely and undesirably shifting position during operating conditions.

The removable attaching mechanism further includes a cylindrical adapter that has a threaded inner surface. Such an adapter has a diameter that is greater than a diameter of the first dowel rod, which is vital such that the distal end of the first dowel rod is threadably interfitted within the adapter. A second dowel rod has axially opposed and threaded proximal and distal ends respectively, and the proximal end of the second dowel rod is simultaneously and threadably interfitted within the adapter when the distal end of the first dowel rod is threadably interfitted within the adapter. The first and second dowel rods respectively are removably interfitted within a hollow cavity of a selected ladder rung of an existing ladder, which is necessary such that the first and second dowel rods respectively maintain the frame and the tray respectively in a stable position and spaced from the existing ladder during operating conditions. The adapter allows the user the choice of employing only the first dowel rod or the first dowel rod and the second dowel rod respectively based upon the size of the existing ladder that the apparatus is being attached to.

The removable attaching mechanism further includes an end cap attached to the distal end of the second dowel rod. Said end cap providing a lateral safety stopping mechanism to the second dowel rod so as to stop the second dowel rod from prematurely and undesirably disconnecting from the ladder rung during operating conditions.

The apparatus further includes a mechanism for securing the tray to the frame. Such securing mechanism includes a plurality of threaded fasteners interfitted within associated ones of the apertures, which is important such that the top surface of the lower frame abuts directly against a bottom surface of the platform during operating conditions. Such fasteners statically adhere the lower frame to the platform.

The use of a first and a second dowel rod respectively provides the unexpected benefit of allowing the user to employ the apparatus with a multitude of differently sized existing ladders. In addition, the "C"-shape of the frame allows the user to easily place and retrieve odd shaped objects within the tray, thereby overcoming the prior art shortcomings.

A method of installing and utilizing a paint tray caddy includes the steps of positioning an existing ladder against a work surface, loading a tray with various materials required to complete a job, threading a first dowel rod into a selected opening in a selected locking plate and through a hanging tube, grasping the hanging tube as a handle, transporting the paint tray caddy up the existing ladder, inserting the first dowel rod into a selected ladder rung, determining whether the paint tray caddy is hanging level, and if no, reinstalling the first dowel rod into a different one of the openings of the locking plate, inserting a threaded end of a second dowel rod into an opposite side of the ladder rung, engaging a threaded adapter, and threading the second dowel rod within the adapter until snug.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

| | |
|---|---|
| 10 | paint tray caddy for extension ladders |
| 20 | hanging tube |
| 21 | locking plate |
| 22 | first stop mechanism |
| 23 | upper arm |
| 24 | rear arm |
| 25 | lower frame |
| 26 | fasteners |
| 27 | pivot ear |
| 28 | second stop mechanism |
| 30 | side panel |
| 31 | tray |
| 40 | end cap |
| 41 | first dowel rod |
| 42 | second dowel rod |
| 43 | threaded adapter |
| 70 | ladder |

DETAILED DESCRIPTION OF THE PREFERRED EMBODIMENT

Figure 1:
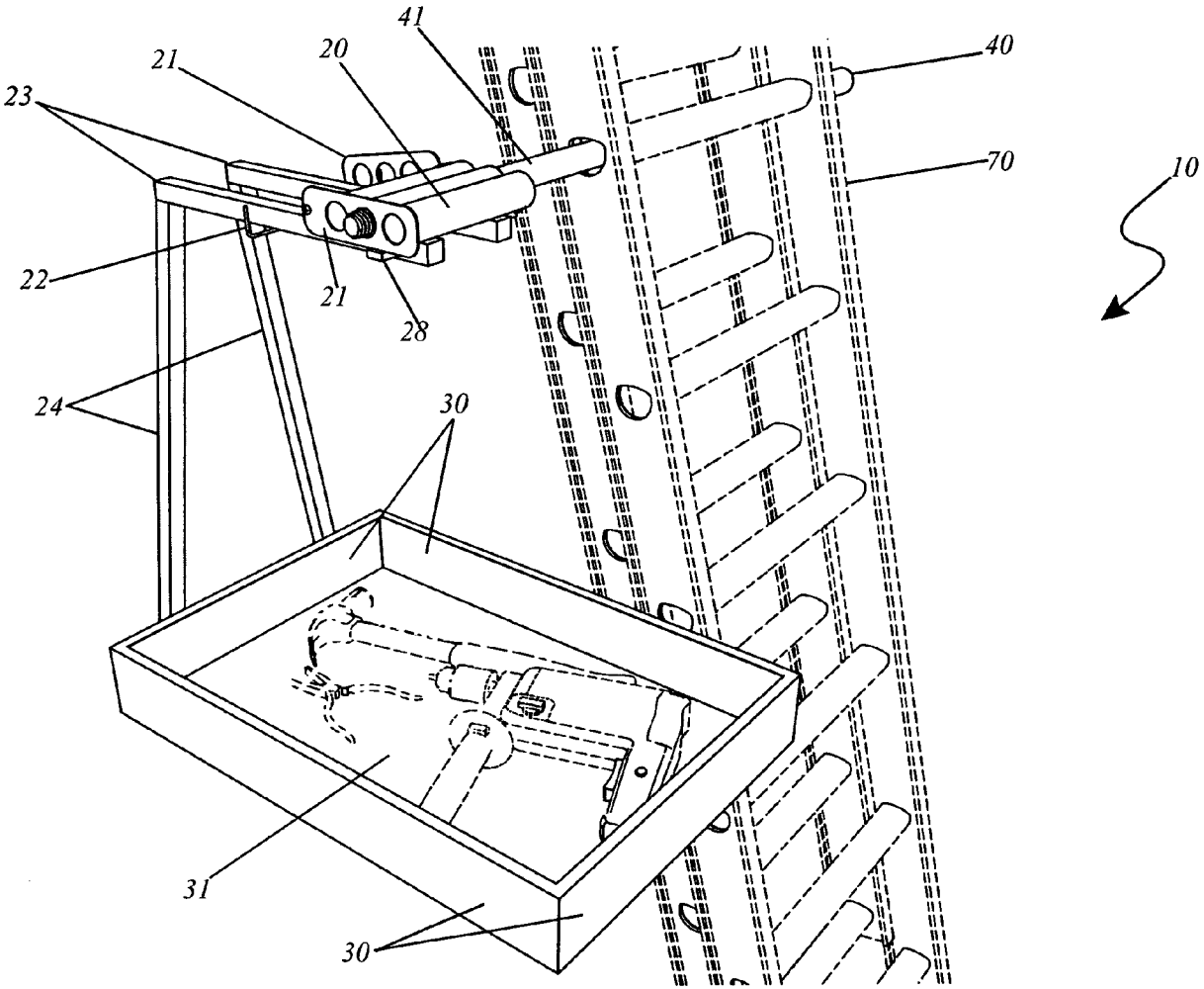
FIG. 1 is an environmental view of the paint tray caddy for extension ladders 10, according to a preferred embodiment of the present invention.
Figure 2:
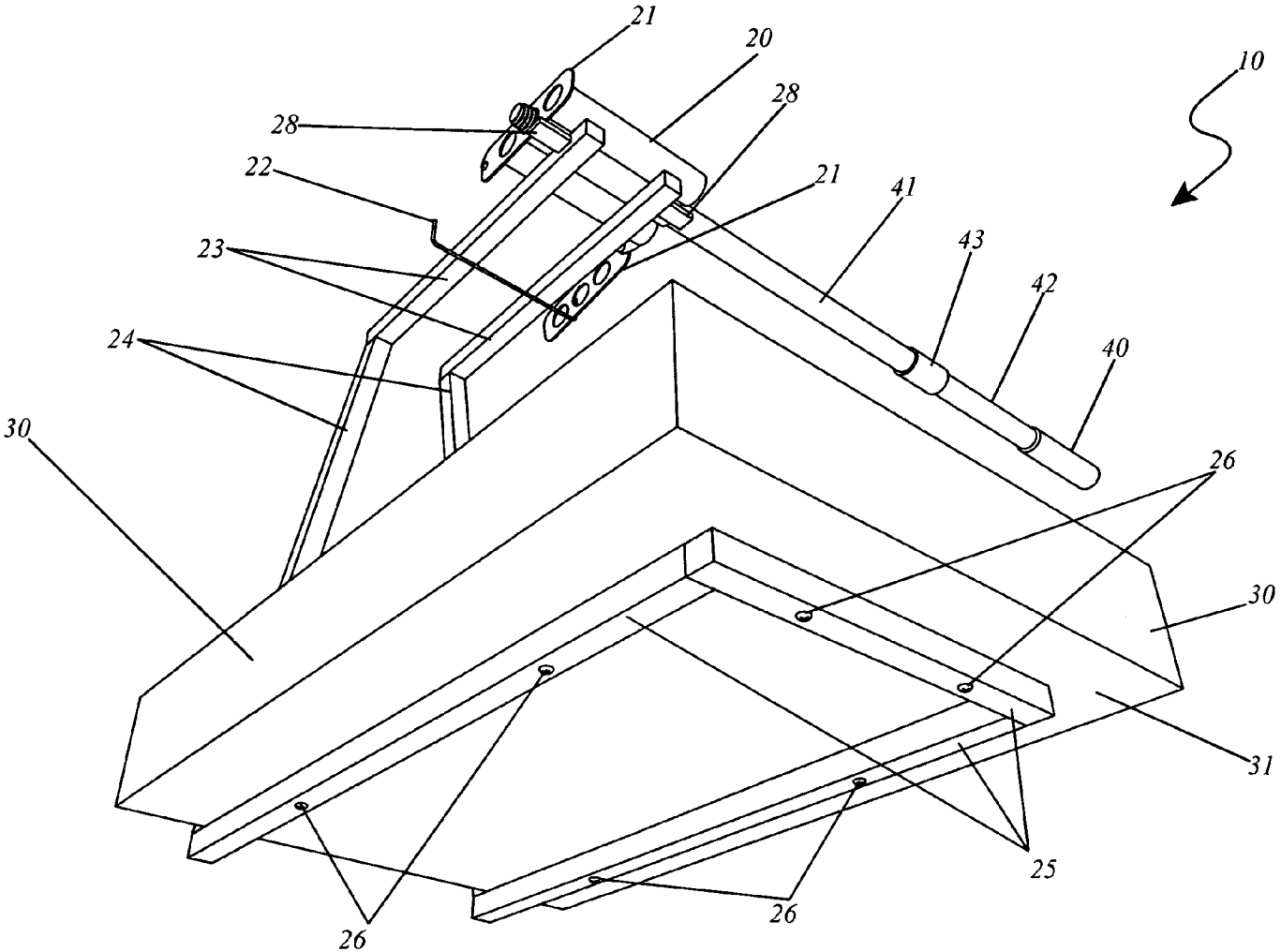
FIG. 2 is a upward looking view of the paint tray caddy for extension ladders 10, according to a preferred embodiment of the present invention; and, FIG. 3 is a close-up view of the attachment portion of the paint tray caddy for extension ladders 10, according to a preferred embodiment of the present invention.
Figure 3:
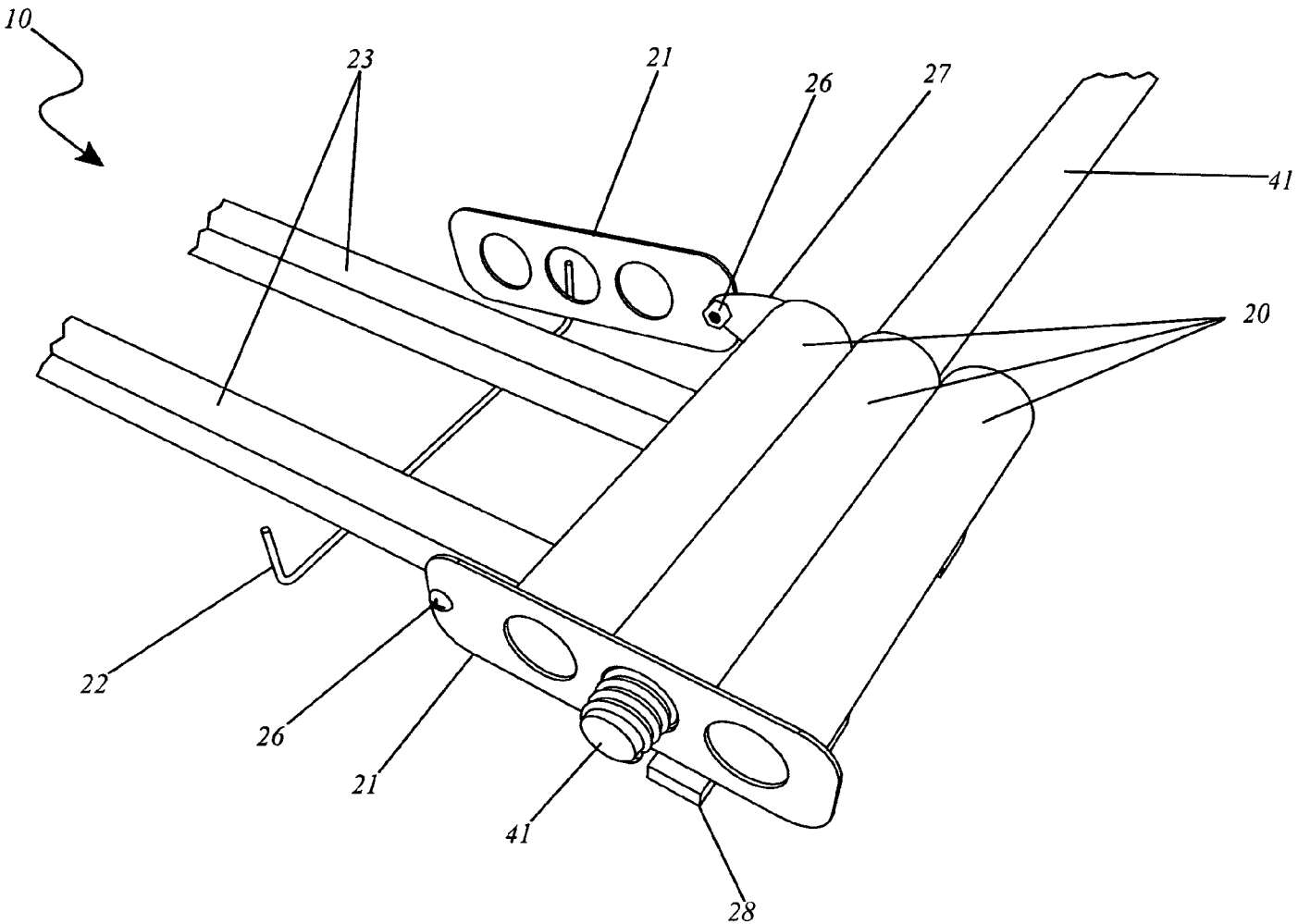

The best mode for carrying out the invention is presented in terms of its preferred embodiment, herein depicted within FIGS. 1 through 3. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes an apparatus and method for a paint tray caddy for extension ladders (herein described as the "apparatus") 10, which provides a means for a caddy apparatus designed to hold paint, construction items, supplies, tools and/or other materials while on an extension ladder 70 without interfering with the safety of a person standing on the ladder. The apparatus 10 comprises a dowel rod 41 which is selectably placed through the hollow cavity of a ladder rung 70 and attaches to a "U"-shaped bracket 23 with a large flat tray 31 for use in holding the aforementioned materials. The apparatus 10 may be easily configured on the left or right side of the ladder 70 and allows workers on extension ladders 70 quick access to tools, supplies and materials in an efficient and safe manner.

Referring now to FIG. 1, an environmental view of the apparatus 10, according to the preferred embodiment of the present invention, is disclosed. The apparatus 10 is illustrated here in use on the job in its left hand configuration. The apparatus 10 comprises three (3) hanging tubes 20, a pair of locking plates 21, a first stop mechanism 22, a pair of upper arms 23, a pair of rear arms 24, a lower frame 25, a plurality of fasteners 26, a pair of pivot ears 27, a second stop mechanism 28, a tray 31, a plurality of tray side panels 30, an end cap 40, and a first dowel rod 41.

The first dowel rod 41 comprises a round rod with a diameter of approximately one (1) inch and a length of approximately 18 inches being sufficient to pass therethrough the rung of a standard extension ladder and engage the hanging tube 20 portion of the apparatus 10. The first dowel rod 41 is envisioned to be similar to a push-broom handle being made of wood; however, other materials may be provided such as plastic, aluminum or the like. The dowel rod 41 further comprises a proximal and a distal end. The distal end of said dowel rod 41 comprises a threaded adapter 43 which provides a threading means to a second dowel rod 42 (see FIG. 2). The proximal end of the dowel rod 41 comprises a threaded end of approximately one inch long, thereby providing a threaded attachment means thereto the holes in the locking plate 21 (see FIG. 3).

The hanging tubes 20 comprise a series of three adjacent cylinders of equal diameter and length being approximately five (5) inches long and positioned in a straight horizontal row, thereby providing an insertion means for the dowel rod 41 (see FIG. 3). The hanging tubes 20 provide an attachment means to the upper arms 23 being welded securely to proximal ends of the upper arm members 23. The hanging tubes 20 also provide an attachment means to the locking plates 21 via the two (2) pivot ears 27. The locking plates 21 provide a left and right configuration means to the apparatus 10 by pivoting the two (2) locking plates 21 into opposite positions (see FIG. 3).

The upper arms 23, the rear arms 24, and the lower frame 25 comprise a symmetrical "C"-shaped frame, thereby providing a support means to the tray 31 and clearance for miscellaneous painting and construction materials residing thereupon said tray 31. The upper arms 23 are to be securely welded to the hanging tubes 20 and sized such that the hanging tubes 20 are vertically positioned above the center of the tray 31, thereby aligning said hanging tubes 20 with the approximate center of gravity of the apparatus 10. The upper arms 23 provide an attachment means being securely welded to the rear arms 24. The rear arms 24 comprise a pair of generally vertical divergent members approximately thirteen (13) inches long. The rear arms 24 further provide an attachment means to the lower frame 25 (see FIG. 3) being securely welded thereto. The upper arms 23 and the rear arms 24 are illustrated in the preferred embodiment being a weldment of square aluminum or steel tubing; however, said components may be provided in a variety of materials and construction such as bent round tubing, angled shapes, or the like, and as such should not be interpreted as a limiting factor of the present invention 10.

The tray 31 provides containment means comprising a horizontal platform approximately 12" wide by 18" wide being large enough to support a roller-painting tray. The tray 31 further comprises four (4) side panels 30 having a height of approximately one (1) to two (2) inches. The tray 31 is envisioned to be constructed using lightweight materials such as plastic, wood, fiberglass, aluminum, or the like.

Referring now to FIG. 2, an upward looking view of the apparatus 10, according to the preferred embodiment of the present invention, is disclosed. The apparatus 10 is illustrated here giving special attention to the tray 31. The apparatus 10 comprises a threaded adapter 43, a first dowel rod 41, a second dowel rod 42, tray 31, side panels 30, and a lower frame 25. The lower frame 25 provides an attachment means to the tray 31 via a plurality of fasteners 26 such as screws, bolts, rivets, or the like. The lower frame 25 comprises a three (3) sided weldment, thereby forming a frame to support the tray 31. The lower frame 25 is envisioned to be made using square aluminum or steel tubing; however, the said lower frame 25 may be provided in a variety of materials and construction such as bent round tubing, angled shapes, or the like, and as such should not be interpreted as a limiting factor of the present invention 10.

The first dowel rod 41 provides an attachment means to a threaded adapter 43. The threaded adapter 43 is envisioned to be crimped or pressed onto the end of said first dowel rod 41 and provides internal threads to attachment to a second dowel rod 42. The threaded adapter 43 is envisioned to be made of metal, plastic, or the like. The second dowel rod 42 comprises a threaded portion at the proximal end and is envisioned to be provided using materials similar to the first dowel rod 41. The second dowel rod 42 provides an end cap 40 thereon the distal end. The end cap 40 provides a lateral safety stopping means to the second dowel rod 42 being securely mounted and being of a sufficient outside diameter as to stop said second dowel rod 42 from sliding through the ladder rung 70. The end cap 41 is envisioned to provide a manual gripping means to screw said second dowel rod 41 into the threaded adapter 43 during installation of the apparatus 10. The end cap 40 is further envisioned to be made of materials such as rubber, urethane, or the like being fastened to the second dowel rod 42 using various adhesives.

Referring now to FIG. 3, a close-up view of the attachment portion of the apparatus 10, according to the preferred embodiment of the present invention, is disclosed. The apparatus 10 comprises three (3) hanging tubes 20, a pair of locking plates 21, a first stop mechanism 22, a pair of upper arms 23, a plurality of fasteners 26, a pair of pivot ears 27, and a second stop mechanism 28.

The hanging tubes 20 comprise of series of three adjacent cylinders of equal diameter and length being approximately five (5) inches long and positioned in a straight horizontal row, thereby providing an insertion means to the dowel rod 41. The hanging tubes 20 are envisioned to be welded securely to each other to form a single rigid structure. The hanging tubes 20 also provide an attachment means for the pivot ears 27 being welded thereupon the distal end of said hanging tubes 20. The hanging tubes 20 provide a selection of insertion points for the proximal end of the dowel rod 41, thereby maintaining a level attitude for the tray 31 as the center of gravity may shift depending on the type and position of equipment in said tray 31. The hanging tubes 20 are envisioned to be made using lightweight materials such as aluminum, steel tubing, or the like. The pivot ears 27 provide an attachment means to the locking plates 21 using fasteners 26 such as bolts, locking nuts, and the like. The locking plates 21 comprise a single row of three (3) holes which are aligned with the centers of the three (3) hanging tubes 20. The hanging tubes 20 provide an attachment means to the upper arms 23 being welded securely to the proximal ends of the upper arm members 23.

The locking plates 21 provide a left and right configuration means to the apparatus 10 by pivoting about said fasteners 26 into opposite positions with one locking plate 21 being positioned against the first stop mechanism 22 at the rear while the other locking plate 21 is resting against the second stop mechanism 28 at the front. The locking plates 21 provide a threaded attachment means to the dowel rod 41 as said dowel rod 41 passes slidingly through the hanging tube 20, engages the locking plate 21, and threads through the locking plate hole 21.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIG. 1.

The method of installing and utilizing the apparatus 10 may be achieved by performing the following steps: positioning a ladder 70 properly against a work surface; loading the tray with various materials required to complete the job; threading the first dowel rod 41 into a desired hole in the locking plate 21 and through the hanging tube portion 20; grasping the hanging tube portion 20 as a handle; transporting the apparatus 10 up the ladder 70 and inserting the first dowel rod 41 into a desired ladder rung 70; checking to see if the apparatus 10 is hanging level and if required, reinstalling the dowel rod 41 in a different locking plate hole 21; inserting the threaded end of the second dowel rod 42 into the opposite side of the ladder rung 70, engaging the threaded adapter 43, and threading the second dowel rod 42 until snug; and, enjoying the added convenience and safety as well as the reduced fatigue resulting from use of the apparatus 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A paint tray caddy for use with an existing ladder, said paint tray caddy comprising:

a tray, further comprising:

a platform; and, a plurality of side panels monolithically formed along outer edges of said platform, said side panels extending upwardly and away from a top surface of said platform at a right angle, said platform and said side panels respectively cooperating to form an open chamber therebetween;

a frame having a lower end connected to said tray, further comprising:

a pair of coextensively shaped rectilinear upper arms each provided with opposed proximal and distal ends respectively;

a pair of coextensively shaped rectilinear rear arms having respective top ends monolithically formed with respective distal ends of said upper arms, said rear arms having respective longitudinal lengths oriented orthogonally to respective longitudinal lengths of said upper arms, said rear arms extending downwardly and away from said upper arms and terminating at bottom ends respectively;

a lower frame having an open end integrally attached to said bottom ends of each of said rear arms, said lower frame having a closed end extending outwardly and away from said open end of said lower frame, said lower frame having a top surface registered parallel to a bottom surface of said respective upper arms such that said upper arms and said rear arms and said lower frame cooperate to form a substantially "C"-shaped structure; and, a plurality of threaded apertures formed in said lower frame, each of said apertures having a centrally registered axis oriented at a right angle to said top surface of said lower frame and internal threads;

a plurality of coextensively shaped hanging tubes attached directly to a top surface of said proximal ends of said upper arms, said tubes being statically connected horizontally in a side-by-side sequence along respective longitudinal lengths of each of said hanging tubes, each of said tubes having a longitudinal length registered parallel to an associated one of said tubes and further having said respective longitudinal lengths registered at a right angle to said respective longitudinal lengths of said upper arms, said tubes being spaced from said tray and further being oriented above a center region of said tray;

a pair of pivot ears integrally attached to axially opposed ends of a selected one of said tubes, said pivot ears extending away from said selected tube along a horizontal plane and toward said respective distal ends of said upper arms;

a pair of locking plates pivotally attached to said pivot ears, each of said locking plates having a plurality of openings formed therein and equidistantly spaced therealong, each of said openings having a diameter that is equal to a diameter of each of said tubes such that said openings of a selected locking plate are selectively pivotally aligned with each of said hanging tubes;

an elongated first stop member integrally attached to said respective bottom surfaces of said upper arms, said first stop member having a longitudinal length registered perpendicular to said respective longitudinal lengths of said upper arms, said first stop member being located between said tubes and said respective distal ends of said upper arms respectively;

a rectilinear second stop member integrally attached to said respective bottom surfaces of said upper arms, said second stop member having a longitudinal length registered perpendicular to said respective longitudinal lengths of said upper arms, said second stop member being located subjacent of said tubes and spaced from said first stop member;

a first dowel rod having axially opposed and threaded proximal and distal ends respectively, said proximal end of said first dowel rod being removably interfitted within a selected one of said plurality of tubes, said proximal end of said first dowel rod being threadably interfitted within a desired opening of said locking plate when said first dowel rod is removably interfitted within said selected tube;

a cylindrical adapter having a threaded inner surface, said adapter having a diameter that is greater than a diameter of said first dowel rod such that said distal end of said first dowel rod is threadably interfitted within said adapter;

a second dowel rod having axially opposed and threaded proximal and distal ends respectively, said proximal end of said second dowel rod being simultaneously and threadably interfitted within said adapter when said distal end of said first dowel rod is threadably interfitted within said adapter; and, an end cap attached to said distal end of said second dowel rod; and, means for securing said tray to said frame;

wherein said first and second dowel rods respectively are removably interfitted within a hollow cavity of a selected ladder rung of said ladder, said first and second dowel rods respectively maintaining said frame and said tray respectively in a stable position and spaced from said ladder; and, wherein said end cap is providing a lateral safety stopping means to the second dowel rod so as to stop said second dowel rod from disconnecting from the ladder rung.

2. The paint tray caddy of claim 1, wherein said securing means comprises:

a plurality of threaded fasteners interfitted within associated ones of said apertures such that said top surface of said lower frame abuts directly against a bottom surface of said platform, said fasteners statically adhering said lower frame to said platform.

3. A paint tray caddy for use with an existing ladder, said paint tray caddy comprising:

a substantially rectangular-shaped tray having longitudinally opposed ends, further comprising:

a platform; and, a plurality of side panels monolithically formed along outer edges of said platform, each of said side panels having an equal height, said side panels extending upwardly and away from a top surface of said platform at a right angle, said platform and said side panels respectively cooperating to form an open chamber therebetween;

a frame having a lower end connected to said tray, further comprising:

a pair of coextensively shaped rectilinear upper arms each provided with opposed proximal and distal ends respectively;

a pair of coextensively shaped rectilinear rear arms having respective top ends monolithically formed with respective distal ends of said upper arms, said rear arms having respective longitudinal lengths oriented orthogonally to respective longitudinal lengths of said upper arms, said rear arms extending downwardly and away from said upper arms and terminating at bottom ends respectively;

a lower frame having an open end integrally attached to said bottom ends of each of said rear arms, said lower frame having a closed end extending outwardly and away from said open end of said lower frame, said lower frame having a top surface registered parallel to a bottom surface of said respective upper arms such that said upper arms and said rear arms and said lower frame cooperate to form a substantially "C"-shaped structure; and, a plurality of threaded apertures formed in said lower frame, each of said apertures having a centrally registered axis oriented at a right angle to said top surface of said lower frame and internal threads, said apertures being equidistantly spaced along said lower frame;

a plurality of coextensively shaped hanging tubes attached directly to a top surface of said proximal ends of said upper arms, said tubes being statically connected horizontally in a side-by-side sequence along respective longitudinal lengths of each of said hanging tubes, each of said tubes having a longitudinal length registered parallel to an associated one of said tubes and further having said respective longitudinal lengths registered at a right angle to said respective longitudinal lengths of said upper arms, said tubes being spaced from said tray and further being oriented above a center region of said tray;

a pair of pivot ears integrally attached to axially opposed ends of a selected one of said tubes, said pivot ears extending away from said selected tube along a horizontal plane and toward said respective distal ends of said upper arms;

a pair of locking plates pivotally attached to said pivot ears, each of said locking plates having a plurality of openings formed therein and equidistantly spaced therealong, each of said openings having a diameter that is equal to a diameter of each of said tubes such that said openings of a selected locking plate are selectively pivotally aligned with each of said hanging tubes;

an elongated first stop member integrally attached to said respective bottom surfaces of said upper arms, said first stop member having a longitudinal length registered perpendicular to said respective longitudinal lengths of said upper arms, said first stop member being located between said tubes and said respective distal ends of said upper arms respectively;

a rectilinear second stop member integrally attached to said respective bottom surfaces of said upper arms, said second stop member having a longitudinal length registered perpendicular to said respective longitudinal lengths of said upper arms, said second stop member being located subjacent of said tubes and spaced from said first stop member;

a first dowel rod having axially opposed and threaded proximal and distal ends respectively, said proximal end of said first dowel rod being removably interfitted within a selected one of said plurality of tubes, said proximal end of said first dowel rod being threadably interfitted within an associated one of said openings of said locking plate when said first dowel rod is removably interfitted within the selected tube;

a cylindrical adapter having a threaded inner surface, said adapter having a diameter that is greater than a diameter of said first dowel rod such that said distal end of said first dowel rod is threadably interfitted within said adapter;

a second dowel rod having axially opposed and threaded proximal and distal ends respectively, said proximal end of said second dowel rod being simultaneously and threadably interfitted within said adapter when said distal end of said first dowel rod is threadably interfitted within said adapter;

an end cap attached to said distal end of said second dowel rod; and, means for securing said tray to said frame;

wherein said first and second dowel rods respectively are removably interfitted within a hollow cavity of a selected ladder rung of said ladder, said first and second dowel rods respectively maintaining said frame and said tray respectively in a stable position and spaced from said ladder; and, wherein said end cap is providing a lateral safety stopping means to the second dowel rod so as to stop said second dowel rod from disconnecting from the ladder rung.

4. The paint tray caddy of claim 3, wherein said securing means comprises:

a plurality of threaded fasteners interfitted within associated ones of said apertures such that said top surface of said lower frame abuts directly against a bottom surface of said platform during operating conditions, said fasteners statically adhering said lower frame to said platform.

* * * * *